US006637389B2

(12) United States Patent
Schafer et al.

(10) Patent No.: US 6,637,389 B2
(45) Date of Patent: Oct. 28, 2003

(54) ELECTRICALLY DRIVEN DEVICE FOR ANGULAR ADJUSTMENT OF A SHAFT RELATIVE TO ITS DRIVE

(75) Inventors: Jens Schafer, Herzogenaurach (DE); Hans Fleischer, Herdecke (DE)

(73) Assignee: INA Walzlager Schaeffler oHG (DE)

( * ) Notice: Subject to any disclaimer, the term of this patent is extended or adjusted under 35 U.S.C. 154(b) by 238 days.

(21) Appl. No.: 10/003,899

(22) Filed: Oct. 26, 2001

(65) Prior Publication Data

US 2002/0053327 A1 May 9, 2002

(30) Foreign Application Priority Data

Nov. 4, 2000 (DE) ..... 100 54 798

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 5,293,845 A * 3/1994 Yamazaki et al. ..... 123/90.17
5,860,328 A * 1/1999 Regueiro ..... 74/568 R
6,138,622 A * 10/2000 Heer ..... 123/90.17
6,167,854 B1 * 1/2001 Regueiro ..... 123/90.17
6,257,186 B1 * 7/2001 Heer ..... 123/90.17

FOREIGN PATENT DOCUMENTS

| | | |
|---|---|---|
| DE | 8611098 | 8/1986 |
| DE | 4110195 | 10/1992 |
| DE | 4133408 | 4/1993 |
| DE | 19502834 | 8/1996 |
| DE | 19910210 | 9/2000 |

* cited by examiner

*Primary Examiner*—Weilun Lo
(74) *Attorney, Agent, or Firm*—Bierman, Muserlian and Lucas

(57) ABSTRACT

The invention relates to an electrically driven device (1) for the angular adjustment of a shaft relative to its drive (2), said device comprising an eccentric gearing that comprises at least one internally geared wheel and one spur gear that meshes with the internally geared wheel and can be driven by an electrically rotatable eccentric shaft. The considerable structural complexity and space requirement as also the noise level of prior art devices is reduced by the fact that the internally geared wheel is configured as a first and a second internally geared wheel (6, 9), and the spur gear is configured as a first and a second spur gear (16, 17) that have the same number of teeth and are rotatable in opposite directions, the internally geared wheels (6, 9) are connected to the drive (2) and the spur gears (16, 17) are connected to the camshaft and can be driven through a double eccentric shaft (20) comprising identical eccentrics (18, 19) arranged offset at 180° to each other.

9 Claims, 1 Drawing Sheet

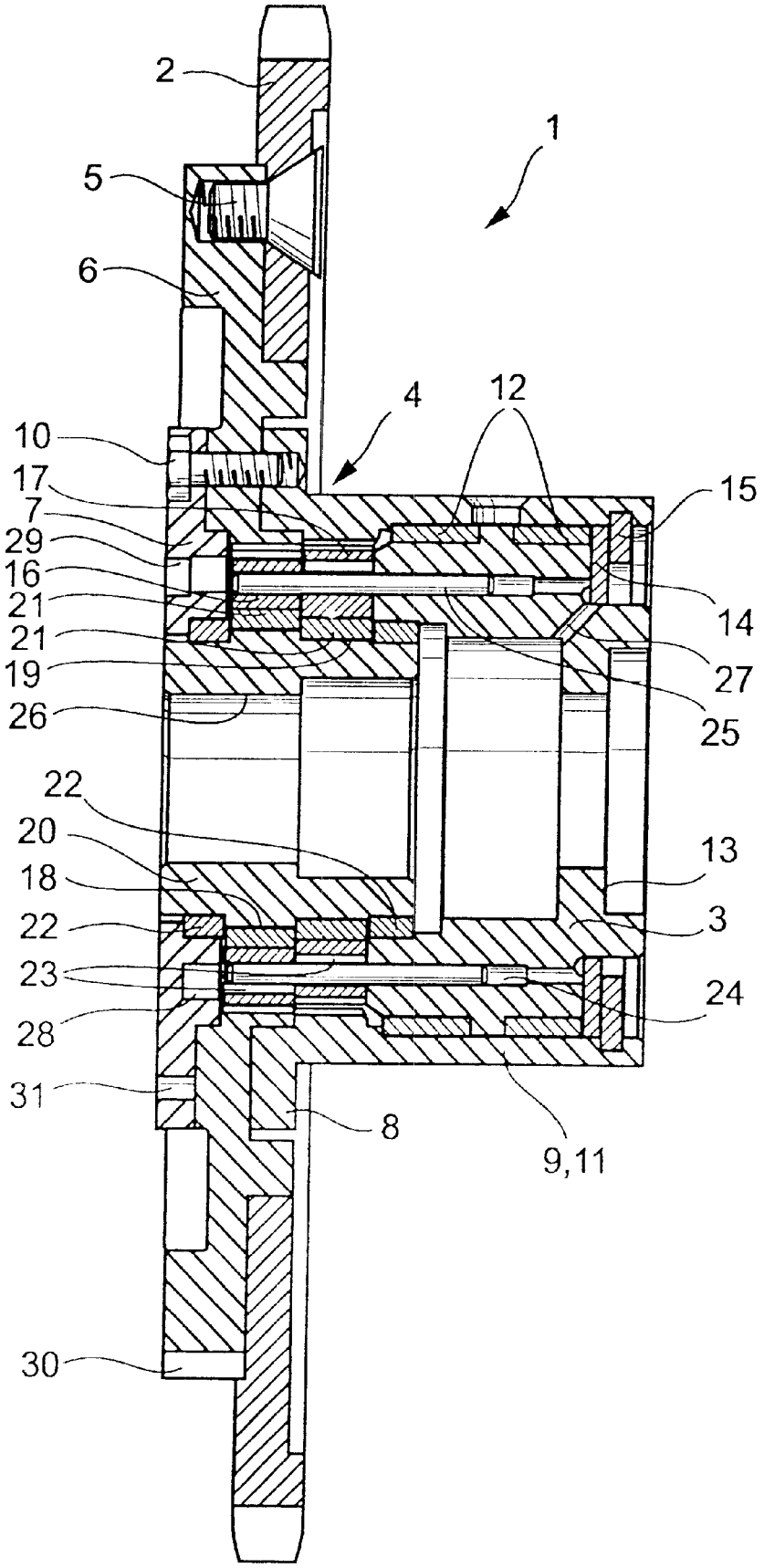
2
1
5
6
4
12
10
17
7
29
16
21
21
19
26
15
14
27
25
22
20
18
22
23
28
31
13
3
24
8
9,11
30

ELECTRICALLY DRIVEN DEVICE FOR ANGULAR ADJUSTMENT OF A SHAFT RELATIVE TO ITS DRIVE

FIELD OF THE INVENTION

The invention concerns an electrically driven device for angular adjustment of a camshaft relative to a crankshaft of an internal combustion engine, said device comprising an eccentric gearing comprising at least one internally geared wheel and one spur gear that meshes with the internally geared wheel and is adapted to be driven by an electrically rotatable eccentric shaft.

BACKGROUND OF THE INVENTION

DE 41 10 195 C2 describes a generic electrically driven device for the angular adjustment of a camshaft relative to a crankshaft of an internal combustion engine. This device comprises an eccentric gearing that comprises at least one internally geared wheel and one spur gear meshing with the internally geared wheel, which spur gear can be driven by an eccentric shaft that is rotatable by an electromotor.

With regard to the number, configuration and design space requirement of its components, and particularly of its gears, this device is complex and expensive to manufacture. Besides this, noise and vibration problems are encountered due to the large number of meshing teeth and the lacking balance of masses.

The above applies substantially also to the electrically driven adjusting device described in DE 41 33 408 A1. Although a mass balance is provided for the outer eccentrics, these possess a high mass moment of inertia that necessitates a corresponding amount of adjusting work.

OBJECTS OF THE INVENTION

It is an object of the invention to improve a generic electrically driven device for the angular adjustment of a camshaft relative to a crankshaft of an internal combustion engine so that the device has a simple structure and a small design space requirement while, at the same time, the noise and vibration level is lowered. This and other objects and advantages of the invention will become obvious from the following detailed description.

SUMMARY OF THE INVENTION

The invention achieves the above objects by the fact that the internally geared wheel is configured as a first and a second internally geared wheel, and the spur gear is configured as a first and a second spur gear that have the same number of teeth and are rotatable in opposite directions, the internally geared wheels are connected to the crankshaft and the spur gears are connected to the camshaft and can be driven through a double eccentric shaft comprising identical eccentrics arranged offset at 180° to each other. The configuration as divided internally geared wheels and spur gears permits a rotation of these in opposite directions for compensating flank clearance, while the identical eccentrics offset at 180° effect the balancing of masses. This results in a low-noise and low-vibration operation of the eccentric gearing. The direct connection of the internally geared wheels to the driving component and the spur gears to the driven component leads to the formation of a space and cost saving single-stage adjusting gearing.

Due to the fact that the internally geared wheels and the spur gears have the same number of teeth, it is possible to manufacture each of these in larger numbers economically in a single pass (e.g. by broaching).

Due to the osculation of the outer contour of the spur gears with the inner contour of the internally geared wheels, the degree of overlap is not limited only to one or two teeth as in the case of common-type toothed gears but lies between 0.15 to 0.2 of the total number of teeth. For this reason, despite the small module, a high torque can be transmitted. Besides this, in most cases, a hardening of the teeth can be dispensed with. The small module also permits a very compact structure of the eccentric gearing.

It has proved to be of advantage that a rotationally fast connection of the spur gears to a driven shaft that is fixed to the camshaft is realized through a separable coupling. This enables a simple assembly and disassembly of the adjusting device.

Advantageously again, the separable coupling is configured preferably as a pin coupling comprising driving pins that are pressed into axially parallel shaft bores of the driven shaft and engage positively into axially parallel spur gear bores of the spur gears.

In place of the pin coupling, it is also possible to use a segment coupling or an Oldham coupling in which projecting transmission elements of one side of the coupling engage into corresponding recesses of the other side of the coupling. None of these couplings have circumferential backlash but through their axial and radial play, they can compensate for tolerances.

Due to the fact that the diameter of the spur gear bores is equal at least to the diameter of the driving pins augmented by twice the eccentricity of the eccentrics, the pin coupling can be plugged together in a simple manner. A further important pre-requisite for this is the correspondence of the pitch circle diameter and the pitch of the spur gear bores and the shaft bores.

According to another important provision of the invention, elimination of tooth flank clearance and of the play between the driving pins and the spur gear bores is achieved by the fact that the first and second internally geared wheels can be braced together with a cover by flange screws that can be screwed into the second internally geared wheel and that the flange screws have a larger clearance in the first internally geared wheel than in the cover. An elimination of play can be achieved in that, with loosened flange screws, the internally geared wheels are held and rotated slightly against each other by a tool that engages into the pin bore of the cover and the notch of the first internally geared wheel. The circumferential backlash required for this purpose is present in the through-holes for the flange screws in the first internally geared wheel. In this way, the elimination of circumferential backlash can be effected in the installed state of the adjusting device from its side situated away from the camshaft.

Alternatively, an abutment of the driving pins in the spur gear bores and of the tooth flanks against each other can be effected and the flank clearance thus eliminated or reduced to a desired size, for example, by an electromotive rotation of the double eccentric shaft during which the camshaft is held fast and the internally geared wheels are loosened but also held fast. Following this, the flange screw connection must be tightened so as to fix this state.

A minimization of the bearing friction in the device is achieved in that the spur gears, the double eccentric shaft and the driven shaft are preferably mounted in rolling bearings. However, the rolling bearings can also be replaced at least partly with oil-drenched bronze or plastic bearings.

The increase of friction brought about by this favors the achievement of self-locking. Besides this, sliding bearings reduce the overall size and structural complexity. However, self-locking is influenced, above all, by an appropriate choice of the transmission ratio.

BRIEF DESCRIPTION OF THE DRAWINGS

Further features of the invention will become obvious from the following description and claims as also from the appended drawing which shows a schematic representation of one example of embodiment of the invention. The sole figure shows a longitudinal section through the device of the invention for an angular adjustment of a camshaft relative to a crankshaft of an internal combustion engine.

DETAILED DESCRIPTION OF THE DRAWINGS

The device 1 comprises a drive 2 and a driven shaft 3 that are kinematically connected through an eccentric gearing 4. In the present case, the drive 2 is configured as a chain sprocket that is in a power-transmitting connection with a crankshaft, not shown, of an internal combustion engine. This connection can also be realized as a gearwheel drive.

The drive 2 is flanged onto a first internally geared wheel 6 with the help of countersunk head screws 5. This internally geared wheel 6 is clamped between a cover 7 and a flange 8 of a second internally geared wheel 9 by flange screws 10.

The second internally geared wheel 9 comprises a bushing 11 on whose inner periphery are arranged two driven shaft bearings 12 for the driven shaft 3. The driven shaft 3 is force-locked with the camshaft, not shown, which is braced against a shoulder 13 of the driven shaft 3 by a central screw, also not shown. On the camshaft-side, the driven shaft 3 is axially fixed by a support disk 14 which, in its turn, is fixed in axial direction by a locking ring 15.

Between the driven shaft 3 and the cover 7 are arranged a first and a second spur gear 16, 17 that are mounted in spur gear bearings 21 on a first and a second eccentric 18, 19 of a double eccentric shaft 20. The eccentrics 18, 19 are identically configured but arranged at an offset of 180° to each other. The double eccentric shaft 20 is mounted in the cover 7 and in the driven shaft 3 on eccentric shaft bearings 22.

In the present case, the bearings 12, 21, 22 are configured as oil-drenched bronze bearings or as plastic bearings but they can all be replaced completely or partly with rolling bearings, preferably in the form of needle roller bearings. This results in a minimization of friction losses in the eccentric gearing 4 but requires that the bearing surfaces have an adequate hardness.

While the two internally geared wheels 6, 9 have the same number of teeth but different configurations, the spur gears 16, 17 are identically configured. Axial spur gear bores 23 are arranged in the spur gears 16, 17, and the pitch circle diameter and pitch of these bores correspond to those of axial shaft bores 24 of the driven shaft 3.

Driving pins 25 are pressed into the shaft bores 24 and extend with clearance into the spur gear bores 23. The diameter of the spur gear bores 23 corresponds to the diameter of the driving pins 25 augmented by twice the eccentricity of the eccentrics 18, 19. The number of driving pins 25 used depends on the magnitude of the torque to be transmitted.

The double eccentric shaft 20 is driven by an electromotor, not shown, whose driven shaft is connected to the double eccentric shaft 20 through a threaded bore 26. The stator can be fixed on the motor housing which results in the advantage of a simple current supply, or it can be fixed on the device which results in the advantage of a smaller gap dimension between the rotor and the stator.

The lubrication of the eccentric gearing 4 is effected, for example, through the hollow central screw, not shown, of the camshaft. The lubricating oil flows from the interior of the driven shaft 3, through the lubricating oil bores 27 and the mounting gap of the driven shaft bearing 12, to the toothing of the gears 6, 9, 16, 17 and to the spur gear bores 23, the oil also flows through the mounting gaps of the eccentric shaft bearings 22 and of the spur gear bearings 21 to an axial groove 28 situated in the cover 7 from where it is discharged through an oil bore 29.

The adjusting device 1 of the invention functions as follows:

Prior to the initial operation of the adjusting device 1, its circumferential backlash must be eliminated to prevent noise and wear. For this, at first the flange screws 10 are loosened and the internally geared wheels 6, 9 are held in place. This is done in the case of the first internally geared wheel 6 with the help of a notch 30 on its periphery, and in the case of the second internally geared wheel 9 with the help of a pin bore 31 in the cover 7, into which bore, in addition to the notch 30, a device can be inserted, if necessary. While the first internally geared wheel 6 is held in place directly through the notch 30, this is done in the case of the second internally geared wheel 9 through the cover 7 and the flange screws 10. When the camshaft has been immobilized, an abutment of the driving pins 25 in the spur gear bores 23 and an abutment of the teeth of the gears 6, 9, 16, 17 against respective opposing flanks can be brought about by turning the internally geared wheels 6, 9 in opposite directions, or by an electromotive rotation of the double eccentric shaft 20. This state is then fixed by tightening the flange screws 10.

In engine operation without angular adjustment of the camshaft, the device 1 works as a denture and pin coupling that rotates as a whole. The camshaft driving torque is transmitted from the drive 2 through the gears 6, 9, 16, 17 to the spur gear bores 23 and the driving pins 25, and from these to the driven shaft 3 and further to the camshaft, in an invariable relative angular position.

If it is desired to change the angular position, the double eccentric shaft 20 must be driven in the one or the other direction by the electromotor. This causes the spur gears 16, 17 to roll with a phase shift of 180° on the internally geared wheels 6, 9 and with the inner periphery of the spur gear bores 23 on the driving pins 25.

This results, for each rotation of the double eccentric shaft 20, in a relative angle of rotation between the internally geared wheels 6, 9 and the spur gears 16, 17 that corresponds to the difference in number of their teeth. Since this difference is preferably only one or two teeth, high transmissions are realized with only one transmission step in a small space compared to planetary gear trains. This permits the use of small high-speed low-torque electromotors for producing the high camshaft adjusting torque. Besides this, with an appropriately high transmission ratio, self-locking can be achieved even when the low-friction rolling bearings are used. This enables the power consumption and the warming-up of the electromotor to be kept at a low level.

By doing without a compensation of circumferential backlash, it is possible to configure the device 1 of the invention with only one internally geared wheel 6 and one spur gear 16 and only one eccentric 18. Mass balancing must be done in this case by using appropriate balancing masses.

What is claimed is:

1. An electrically driven device for angular adjustment of A camshaft relative to a crankshaft of an internal combustion engine, said device comprising an eccentric gearing mechanism comprising a first and a second internally geared wheels and a first and a second spur gears that mesh with the first and second internally geared wheels, respectively, and are adapted to be driven by in electrically rotatable double eccentric shaft, wherein the spur gears have a same number of teeth and are rotatable in opposite directions, the internally geared wheels are connected to thy crankshaft and the spur gears are connected to the camnshaft and is driven by said double eccentric shaft comprising identical eccentrics arranged offset at 180° to each other.

2. A device of claim 1, wherein the spur gears are connected rotationally fast by a separable coupling to a driven shaft fixed to the camshaft.

3. A device of claim 2, wherein the separable coupling is configured as a pin coupling comprising driving pins that are pressed into axially parallel shaft bores of the driven shaft and engage positively into axially parallel spur gear bores of the spur gears.

4. A device of claim 3, wherein a diameter of the spur gear bores is equal at least to a diameter of the driving pins augmented by twice an eccentricity of the eccentrics.

5. A device of claim 4, wherein the spur gear bores and the shaft bores have identical pitch circle diameters and identical pitches.

6. A device of claim 5, wherein the first and second internally geared wheels are braced together with a cover by flange screws that are screwed into the second internally geared wheel and have a larger clearance in the first internally geared wheel than in the cover.

7. A device of claim 6, wherein the cover comprises a pin bore and the first internally geared wheel comprises a notch on a periphery.

8. A device of claim 7, wherein, when the camshaft is held in place and the first and second internally geared wheels are loosened and turned in opposite directions, the driving pins come to abut against an inner contour of the spur gear bores, and tooth flanks of the internally geared wheels and of the spur gears come to bear against one another and can be fixed in this position by tightening the flange screws.

9. A device of claim 8, wherein the spur gears, the double eccentric shaft and the driven shaft are mounted in rolling bearings.

* * * * *